United States Patent [19]

Garrick et al.

[11] 4,003,306

[45] Jan. 18, 1977

[54] PRESS FOR EMBOSSING CEILING TILE

[75] Inventors: John R. Garrick; Nathaniel E. Hager, Jr.; Ernest B. Waters, Jr., all of Lancaster, Pa.

[73] Assignee: Armstrong Cork Company, Lancaster, Pa.

[22] Filed: July 23, 1973

[21] Appl. No.: 381,859

Related U.S. Application Data

[63] Continuation-in-part of Ser. No. 155,418, June 22, 1971, abandoned.

[52] U.S. Cl. ..... 101/27; 101/31; 101/379

[51] Int. Cl.[2] ..... B44B 5/02

[58] Field of Search ..... 101/3, 9, 27, 32, 379

[56] References Cited

UNITED STATES PATENTS

| | | | |
|---|---|---|---|
| 1,572,494 | 2/1926 | Krause | 101/27 |
| 1,906,094 | 4/1933 | Pomell | 101/379 |
| 1,937,195 | 11/1933 | Freeman et al. | 101/27 |
| 2,165,286 | 7/1939 | Mattlage | 101/32 |
| 2,356,951 | 8/1944 | Runton | 101/27 X |
| 2,547,331 | 4/1951 | Lent | 101/21 X |
| 2,621,435 | 12/1952 | Weber | 101/27 |
| 2,803,188 | 8/1957 | Duval | 101/32 |
| 3,601,047 | 8/1971 | Waibel | 101/316 |
| 3,613,570 | 10/1971 | Gladen | 101/379 X |

*Primary Examiner*—Edward M. Coven

[57] ABSTRACT

A punch press is utilized for rapidly embossing ceiling tile. The embossing plate in the press is backed up with a high output heater to assist in the embossing operation.

2 Claims, 2 Drawing Figures

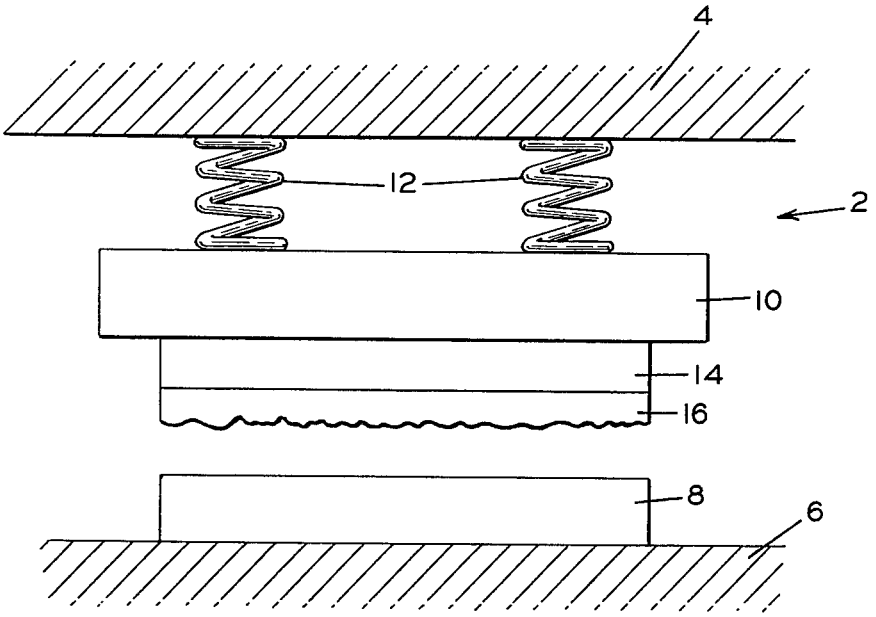
Fig. I
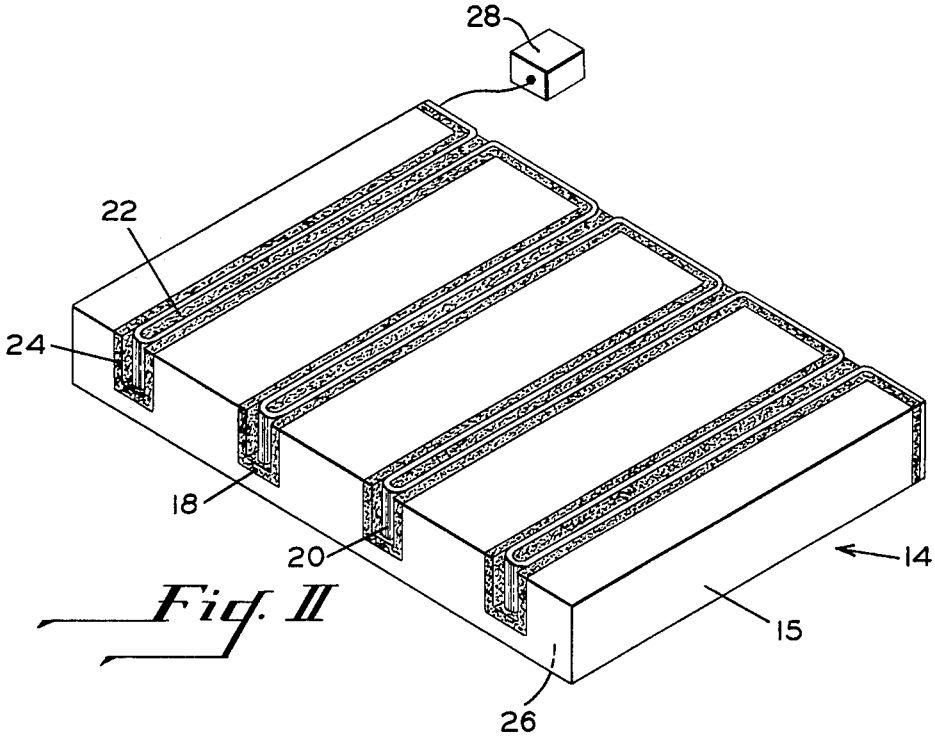
Fig. II

PRESS FOR EMBOSSING CEILING TILE

CROSS REFERENCE TO RELATED APPLICATION

This application is a continuation-in-part of application Ser. No. 155,418, filed June 22, 1971, entitled "Press for Embossing Ceiling Tile," filed in the name of John R. Garrick et al, now abandoned. The above said application and this application are commonly assigned.

BACKGROUND OF THE INVENTION

1. Field of the Invention

The invention is directed to a press for embossing and, more particularly, to a press for embossing fibrous material.

2. Description of the Prior Art

U.S. Pat. No. 2,803,188 shows it is old to emboss the surface of a fiberboard structure to provide it with a decorative effect. Embossing is usually accomplished by the use of a rotary heated embossing roll.

U.S. Pat. No. 1,937,195 discloses an embossing structure with an embossing structure and heater which is utilized to make impressions in shoe uppers.

Flatbed embossing has been used on ceiling boards to provide better detail. The flatbed embossing usually requires three to four minutes contact time between the embossing plate and the board. Shorter times have not been possible due to the sticking of the board to the embossing plate. The press has usually been hot, and the board usually has a wet surface which must be dry before there is release of the board from the embossing plate.

SUMMARY OF THE INVENTION

A punch press is provided with an embossing plate having a three-dimensional surface pattern mounted on the stripper plate of the punching die. The plate is heated to 550° to 800° F. using an electric foil heater mounted behind the plate. The punch die stripper springs, which are behind the stripper plate, close during the down stroke of the press holding the hot embossing plate in contact with the boards. Consequently, there is more than just instantaneous contact of the embossing plate with the die. Full embossing depth is achieved at the bottom of the stroke of the press. On upstroke, the embossing plate remains in contact with the board until the punching die springs are fully extended. The board is then released as the plate is withdrawn. The electric heater puts out a very high output of heat to heat the embossing plate. The plate, in turn, heats the board rapidly. The heater can provide a high output on demand, while maintaining a relatively constant temperature.

The above press produces surprisingly accurate detail at less permanent board compression than when the board is embossed by the rotary method. Also, the short time of contact with the high temperature surface will not result in a burning of the board structure and heats only the surface layer of the board. Finally, the short time of contact of the embossing plate with the board provides a rapid processing operation.

BRIEF DESCRIPTION OF THE DRAWING

FIG. I is a side view of the punch press die structure; and

FIG. II is a perspective view of the die heater.

DESCRIPTION OF THE PREFERRED EMBODIMENT

Referring now to FIG. I, the punch press assembly 2 has an upper punching die 4 and a lower stationary platen 6. The board product 8 to be embossed rests upon the lower stationary platen 6. Mounted on the punching die 4 is a stripper plate 10 which has springs 12 positioned between the stripper plate 10 and the punching die 4. An electrical heater 14 is mounted on the stripper plate between the surface of the stripper plate 10 and the embossing plate 16. The heater is a high output heater which puts out a heat flux of 10 kilowatts per square foot to keep the temperature of the embossing plate 16 at 550° to 800° F. when the plate is in contact with the board. A substantially constant temperature is maintained when the plate contacts the board. The temperature change in the plate at this time rarely exceeds 10° F.

As was indicated above, a punch press assembly is used. A conventional punch press is utilized in carrying out the invention, and this punch is typical of all commercial punch press structures. The presses are cyclically operated in that they move through a stroke at a certain speed based upon the punch press speed and they operate through a cycle which consists of moving the die 4 downward and then back to its original position. The platen 6 is a stationary portion of the punch press and holds the material to be stamped and embossed. In normal operations, the punch press operates at a continuous cyclic rate of approximately 110 strokes per minute. With the above-described cyclic rate and apparatus, contact time between the embossing plate 16 and material to be embossed is approximately ⅓ of a second.

Referring now to FIG. II, there is shown the construction of the heating element 14. The heating element 14 is provided with a plurality of slots 18 in the back surface of the heating element. The slots are positioned so that they will be facing the stripper plate 10 when the heater is mounted on the stripper plate. The slots are positioned about ¼ inch apart and extend across the full width of the stripper plate. A foil type heater 20 is wound through the series of slots in a serpentine manner. The body assembly 15 of the heater is a metallic material of high thermal conductivity and, therefore, the heating foil 20 must be insulated therefrom. Insulating material is provided along the side walls and the bottom of the grooves through which the foil is coiled. Since the foil enters one end of the groove and passes down the full length of the groove, turns and comes back down through the same groove, there must be insulating material between the fold of the foil. Element 22 represents the insulation between the fold of the foil, and elements 24 represent the insulation around the outside of the foil. The foil is now electrically insulated from the metal body 15, but the heat from the foil can be transmitted to the body 15 to warm it and, in turn, warm the embossing plate 16 which is mounted to the surface 26 of the body 15. The foil type heating element uses foils and controls which are similar to those used in U.S. Pat. No. 3,569,665. Any conventional electric heat control 28 can be used both to control the temperature of the heaters and to set it at a certain point. The aforesaid patent describes a control system which could be readily used with the heater structure embodied in the invention of this application. The utilization of the heater in the above-described manner will now provide a heat output flux of 10 kilowatts per square foot, which is now capable of providing a substantial amount of heat to the embossing plate 16.

Movement of the punching die 4 towards the platen 6 will result in the embossing plate 16 engaging the board 8. The heater has been heated and will maintain the plate at 550° to 800° F. depending upon which exact degree within this range is desired. Water and/or a prime coat of paint has previously been applied to the upper surface of the board. The punching die has about a three-inch stroke and it reciprocates at the continuous rate of 110 strokes per minute. As was indicated above, this rate of operation will provide a contact time between the embossing plate and the board of about ⅓ of a second. As the punching die 4 moves downward and the embossing plate 16 engages the board 8, downward movement of the punching die 4 results in compression of the springs 12. Once the springs are fully compressed, then the full pressure of the punching die 4 is applied to the embossing plate 16, through the stripper plate 10 and heater 14. Full embossing depth is achieved at the bottom of the stroke of the punching die 4. On the upward stroke of the punching die 4, the embossing plate remains in contact with the board until the springs 12 are fully extended. The embossing plate 16 can then move away from the board 8. Release of the embossing plate 16 from the board 8 rapidly occurs. The prewetting of the board results in the formation of a steam layer between the embossing plate and the board to give good release. The method provides surprisingly accurate detail in the compressible surface of the board. The punch press is operated at 110 strokes per minute and should have an output which will begin to approach the output from a rotary press operation. It is also possible to provide the board with punched air ventilating openings at the same time the board is being embossed. As compared to conventional flatbed embossing, the operation above-described is much faster in operation.

What is claimed is:

1. An apparatus for rapidly embossing a ceiling panel means made of fibrous material by the use of a cyclically operated punch press having a drive means and having a punching die moved by said drive means and a stationary platen for holding the fibrous product to be embossed, said punching die having a stripper plate, spring means being mounted between said punching die and said stripper plate, a high output heat generating means with temperature control means mounted on the stripper plate, an embossing plate means mounted on the heat generating means to be warmed by said heating generating means and for embossing the fibrous product, said high output heat generating means being capable of supplying heat at such a rate that said embossing plate can deliver a heat flux of at least 10 kilowatts per square foot to the product with the embossing plate maintaining a substantially constant temperature whereby the first part of the downward movement of the punching die to the fibrous material to be embossed will cause the heated embossing plate to engage the product, said springs between the punching die and stripper plate are compressed during the second part of the downward movement of the punching die, then upward movement of the punching die away from the fibrous product will let the spring means expand and result in the embossing plate being held against the product until almost the end of the upward movement of the punching die to result in an extended contact of the embossing die with the product and then with final upward movement of the punching die there is a quick release of the embossing plate from the product.

2. The apparatus of claim 1 wherein said embossing plate engages the fibrous material for less than a second and said embossing plate undergoes a temperature change of less than 10° F. with an operating temperature in the range of 550° F. to 800° F. during the time the embossing plate is in contact with the fibrous material.

* * * * *